United States Patent [19]

Tamura

[11] Patent Number: 5,040,441

[45] Date of Patent: Aug. 20, 1991

[54] PUNCHING DEVICE

[75] Inventor: Miyashiro Tamura, Tohgane, Japan

[73] Assignee: New Kon Industrial Co., Ltd., Tokyo, Japan

[21] Appl. No.: 412,833

[22] Filed: Sep. 26, 1989

[30] Foreign Application Priority Data

Oct. 4, 1988 [JP] Japan ..... 63-250649

[51] Int. Cl.[5] ..... B26D 5/08; B27F 1/02

[52] U.S. Cl. ..... 83/166; 83/147; 83/167; 83/520; 83/588; 83/599; 83/620

[58] Field of Search ..... 83/588, 599, 620, 520, 83/147, 166, 167, 162

[56] References Cited

U.S. PATENT DOCUMENTS 3,522,752 8/1970 Ford ..... 83/520
3,628,407 12/1971 Adams ..... 83/520
3,631,575 1/1972 Farris ..... 83/599
4,294,152 10/1981 Land ..... 83/588
4,499,805 2/1985 Mori ..... 83/588
4,757,733 7/1988 Barlow ..... 83/588

*Primary Examiner*—Douglas D. Watts
*Assistant Examiner*—Scott A. Smith
*Attorney, Agent, or Firm*—Darby & Darby

[57] ABSTRACT

A punching device has a base for placing papers thereon, a plurality of single hole device bodies fixedly arranged in one row in the horizontal direction at predetermined distances on the base. Each of the single hole device bodies is provided with a punching rod and an operation handle for moving the punching rod upward and downward. The punching device also has a communicating member for interconnecting the operation handles of the single hole device bodies. The papers placed on the base are punched by the simple upward and downward operation of the operation handles.

4 Claims, 4 Drawing Sheets

PUNCHING DEVICE

BACKGROUND OF THE INVENTION

This invention relates to a punching device for punching a bundle of papers in order to keep them in a binder.

The conventional punching device includes a base and a punching mechanism mounted on the base. In this type of a punching device, the base itself constitutes a body of the device. Further, the lower side of the base is used as a reservoir for storing punching odds and chips, that is paper scraps or punch-outs. In this type of a punching device, the quantity of odds and chips stored in the reservoir cannot be seen from outside. The outlet port of the reservoir is merely provided with a cap or cover.

SUMMARY OF THE INVENTION

An object of the present invention is to provide a punching device in which the base is sufficient if it works as a table for placing papers thereon and is not required to have a punching function, and a plurality of single hole device bodies are arranged on the base so as to ensure an inexpensive and high performance of the punching device.

Another object of the present invention is to provide a punching device in which the space for storing the punching odds and chips is large and the quantity of the punching odds and chips can be observed from the outside so as to eliminate the trouble caused by excessive storage of the punching odds and chips.

In order to achieve the above-mentioned objects, there is provided a punching device comprising a base for placing papers thereon, a plurality of single hole device bodies fixedly arranged in one row in the horizontal direction at predetermined distances on said base and each including a punching rod and an operation handle for moving said punching rod upward and downward, a communicating member for interconnecting said operation handles of said plurality of single hole device bodies, a common punching odd and chip storage chamber means formed at rear ends of said plurality of single hole device bodies, and transparent plates for covering a top of said reserving chamber means and adjacent sides and back sides of said single hole device bodies, said punching odd and chip storage chamber means being provided on one side thereof with an outlet port so as to block said chamber means, a cover plate integral with a ruler plate for said papers on said base being slidably mounted on one side surface of said base.

BRIEF DESCRIPTION OF THE DRAWINGS

The drawings show the most preferable embodiment of a punching device according to the present invention, wherein.

PREFERRED EMBODIMENT OF THE INVENTION

Figure 1:
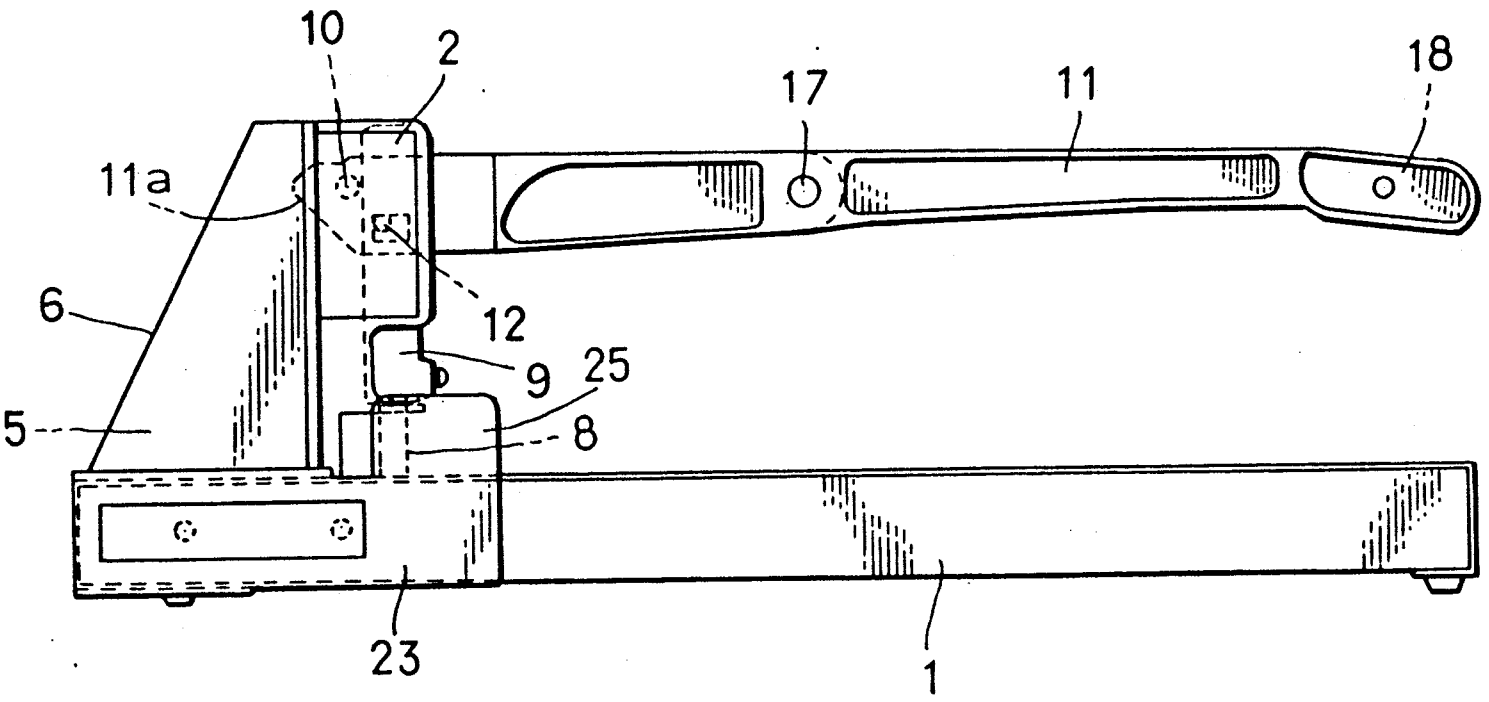
FIG. 1 is a side view.
Figure 2:
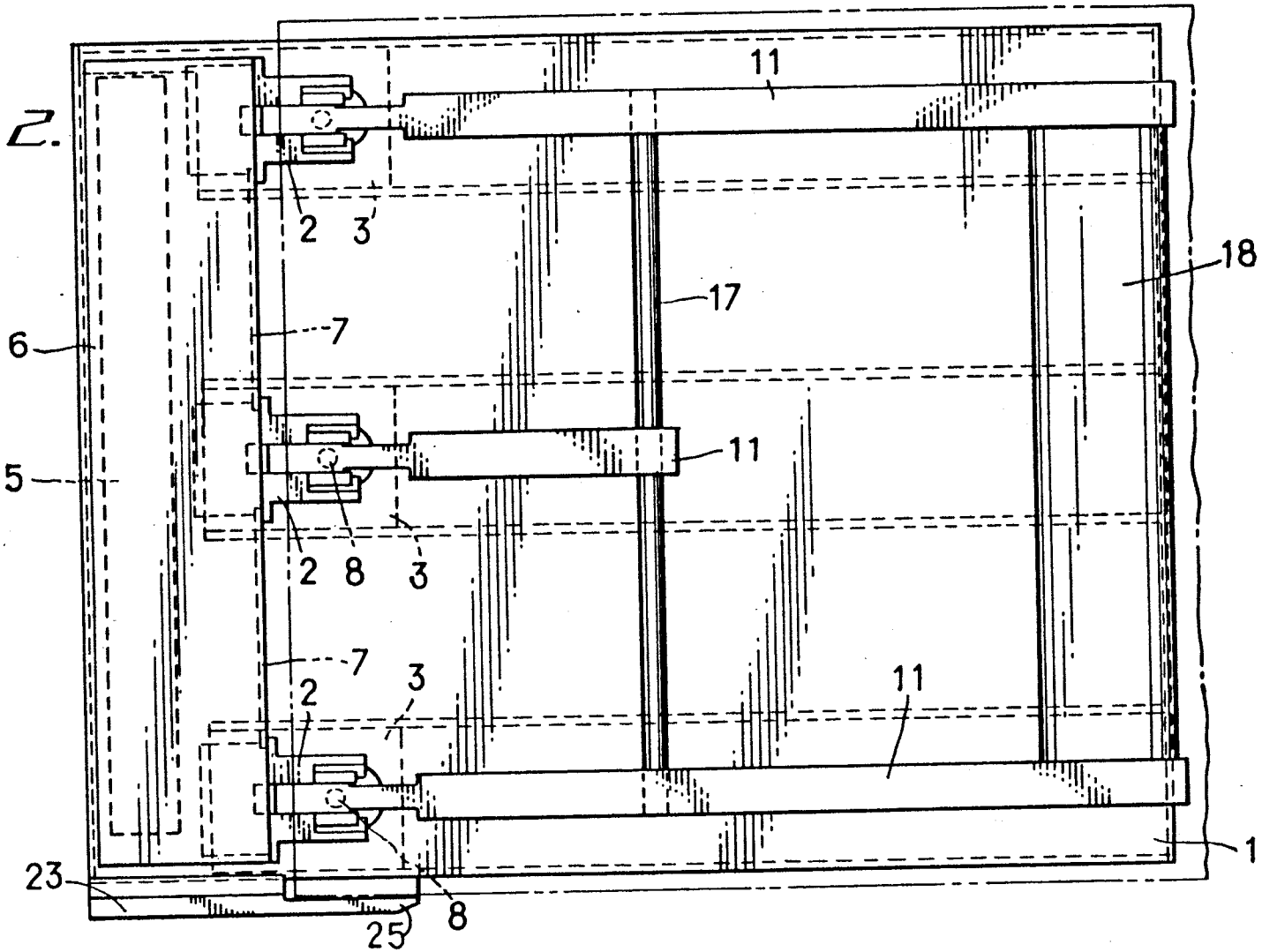
FIG. 2 is a plan view.
Figure 3:
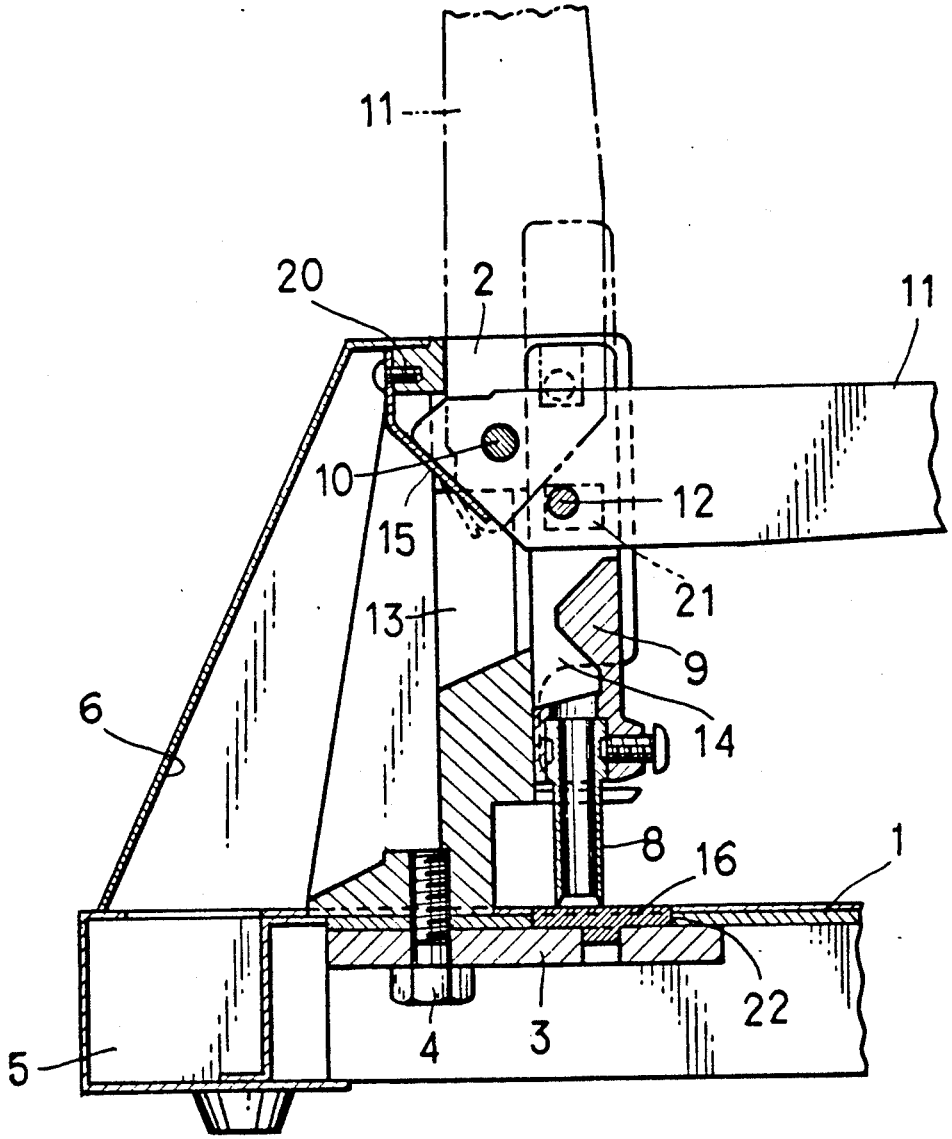
FIG. 3 is a partly cut-away vertical sectional side view.

In the drawings, the numeral 1 denotes a base for supporting a plurality of single hole device bodies 2 and placing thereon a bundle of papers to be punched. In this embodiment, as is shown in FIGS. 2 and 3, three single hole device bodies 2 are fixed to the base 1 through screws 4. A punching odd and chip storage chamber 5 is formed on a rear end of the base 1. A cover frame plate 6 communicated with the storage chamber 5 is commonly put on the respective single hole device bodies 2 and a transparent plate 7 is bridged over the adjacent single hole device bodies 2 so that the quantity of the punching odds and chips in the storage chamber 5 can be seen from outside. The single hole device body 2 is provided with a vertically movably hollow punching rod 8 and its support member 9, and the punching odds and chips are entered into the hollow punching rod 8 and gradually raised upward so as to be discharged from its upper end.

An operation handle 11 is pivotally attached by a shaft 10. The operation handle 11 and the support member 9 are interconnected with each other by utilizing a square hole 21 of the support member 9. In accordance with the upward and downward action of the operation handle 11, the support member 9 and the punching rod 8 are moved together about the shaft 10 as a fulcrum.

Each of the single hole device bodies 2 and each of the support members 9 are formed with a communicating portions 13 and 14 for communicating with the punching odd and chip storage chamber 5. An inclined surface 11*a* formed on the front end of the operation handle 11, and an elastic piece 15 fixed to the single hole device body 2 by a machine screw 20 is urged against the inclined surface 11*a* to stabilize the operation handle 11. The elastic piece 15 is warped when the operation handle 11 is moved. The base 1 has an engaging hole 22 opened up in position immediately under the punching rod 8 (see FIG. 3), and a soft table receiving piece 16 is engaged therein. Furthermore, the three operation handles 11, as shown in FIG. 2, are integrated by the communicating rod 17 and a grip plate 18 so that the three operation handles 11 are moved together. In FIG. 2, only the middle operation handle 11 is short in length.

Figure 4:
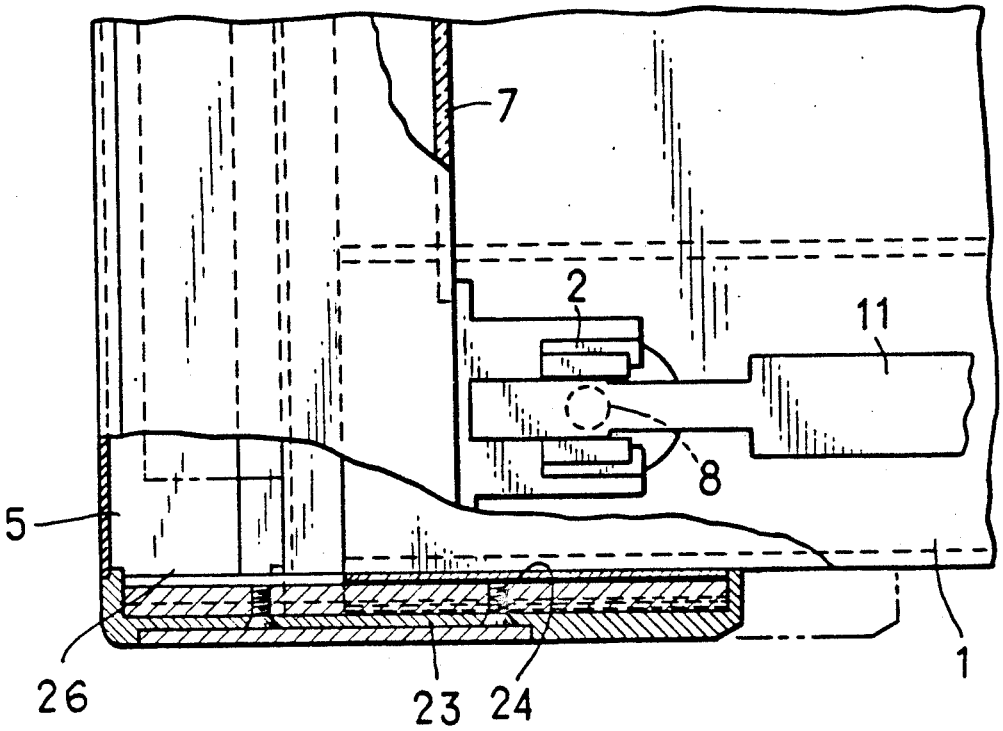
FIG. 4 is a cross sectional view showing an outlet port portion of a punching odd and chip storage chamber.
Figure 5:
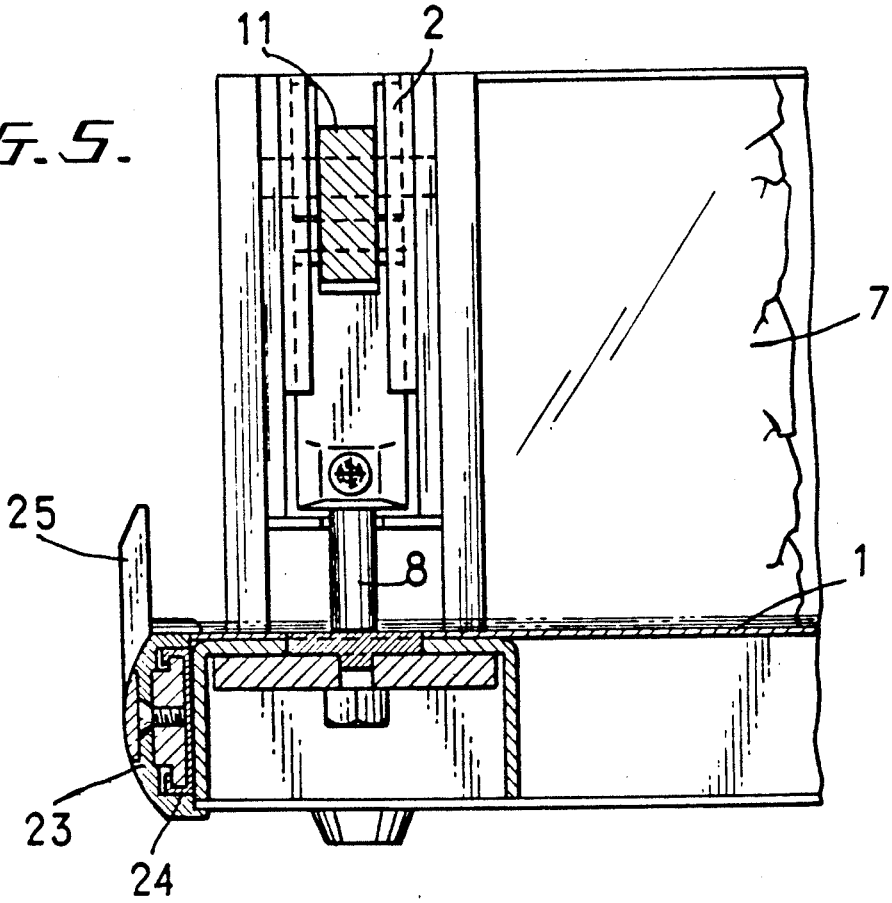
FIG. 5 is likewise a vertical sectional front view.

Next, FIGS. 4 and 5 show the structure of the outlet port portion of the punching odd and chip storage chamber. The outlet port 26 is provided with a cover plate 23 so as to be opened and closed. The cover plate 23 moves along a rail plate 24 which is fixed to the left side surface of the base 1. This cover plate 23 is integrally provided with a ruler plate 25 erected therefrom. The left side portion of the bundle of papers placed on the base 1 is pushed against the ruler plate 25 so as to be arranged in order.

According to the present invention, the base is no more than a table for putting papers thereon. As all mechanisms are not built up on the base as in the prior art, the rigidity in the horizontal direction is no more important, and a small amount of deformation in the horizontal direction does not amplify the punching resistance, either. Also, the plurality of punching rods are operated by one handle in the prior art. On the contrary, in the present invention, as each of the single hole devices is provided with the operation handle, the papers can be punched with a force multiplied by the plurality of rows of a single hole. Furthermore, as the respective single hole device bodies are covered with a common cover frame plate and a transparent plate is interposed between the adjacent single hole device bodies, the quantity of the punching odds and chips can be seen well from outside. And the cover plate for blocking the outlet port also acts as a ruler plate for arranging in order the papers placed on the base. Thus, it has the effect that one member can acts as a cover and a ruler plate.

What is claimed is:

1. A punching device, comprising:

a base for placing papers thereon;

a plurality of single hole device bodies fixedly arranged in a single row in the horizontal direction at predetermined distances between said bodies on said base, each body including a hollow punching rod and each body including an operation handle for moving said punching rod upward and downward;

a communicating member for interconnecting said operation handles of said plurality of single hole device bodies, said device bodies operating in unison upon actuation of said communicating member;

a scrap storage chamber including a transparent plate interposed between said adjacent single hole device bodies; and a cover frame plate adapted to cover the rear ends of said plurality of single hole device bodies, said frame plate closing said chamber from above, and each of said plurality of single hole device bodies being provided with a communicating portion for feeding punching scraps gradually discharge from the top of said punching rod, into said punching scrap storage chamber.

2. A punching device, comprising:

a base for placing papers thereon;

a plurality of single hole device bodies fixedly arranged in a single row in the horizontal direction at predetermined distances between said bodies on said base, each body including a punching rod and each body including an operation handle for moving said punching rod upward and downward;

a communicating member for interconnecting said operation handles of said plurality of single hole device bodies, said device bodies operating in unison upon actuation of said communicating member, and further comprising a scrap storage chamber formed at a rear end of said base on which said plurality of single hole device bodies are fixedly arranged, and a transparent plate for covering an outlet port formed on one side of said scrap chamber is integrally provided with a ruler plate elevated above said base for aligning papers placed on said base.

3. A punching device as in claim 2, wherein said punching rods are hollow.

4. A punching device as in claim 3, wherein said base includes a planar horizontal surface for resting paper to be punched thereon, said punching rod in said downward motion extending to be substantially flush with said horizontal surface.

* * * * *